US005973708A

United States Patent [19]

Fassler et al.

[11] Patent Number: 5,973,708

[45] Date of Patent: Oct. 26, 1999

[54] AIR ISOLATION OF INK SEGMENTS BY MICROFLUIDIC PRINTING

[75] Inventors: Werner Fassler; Xin Wen, both of Rochester; Charles D. DeBoer, Palmyra, all of N.Y.

[73] Assignee: Eastman Kodak Company, Rochester, N.Y.

[21] Appl. No.: 08/942,879

[22] Filed: Oct. 2, 1997

[51] Int. Cl.[6] ..... B41J 2/005

[52] U.S. Cl. ..... 346/140.1

[58] Field of Search ..... 347/48, 54, 85; 346/140.1

[56] References Cited

U.S. PATENT DOCUMENTS

| | | | |
|---|---|---|---|
| 4,419,673 | 12/1983 | Ebi et al. | 347/48 |
| 4,485,387 | 11/1984 | Drumheller | 346/140.1 |
| 5,402,163 | 3/1995 | Maximovsky et al. | 347/54 |
| 5,485,187 | 1/1996 | Okamura et al. | 347/85 |
| 5,745,128 | 4/1998 | Lam et al. | 346/140.1 |

FOREIGN PATENT DOCUMENTS

| | | | |
|---|---|---|---|
| 360089370 | 5/1985 | Japan | 347/48 |
| 2262717 | 6/1993 | United Kingdom | 347/54 |

*Primary Examiner*—N. Le
*Assistant Examiner*—Lamson D. Nguyen
*Attorney, Agent, or Firm*—Raymond Owens

[57] ABSTRACT

A microfluidic printing apparatus for transferring ink to a receiver includes at least one ink reservoir; a structure defining a plurality of chambers arranged so that the chambers form an array with each chamber being arranged to form an ink pixel; a plurality of microchannels connecting the reservoir to a chamber; and a plurality of microfluidic pumps each being associated with a single microchannel for supplying ink from an ink reservoir through a microchannel for delivery to a particular chamber. Air is delivered to isolate ink in the chamber so that a predetermined amount of ink in the chamber can be transferred to a receiver, and the microfluidic pumps are operated for delivering the predetermined amount of ink to each chamber.

3 Claims, 5 Drawing Sheets

AIR ISOLATION OF INK SEGMENTS BY MICROFLUIDIC PRINTING

CROSS REFERENCE TO RELATED APPLICATIONS

The present invention is related to U.S. patent application Ser. No. 08/868,426 filed Jun. 3, 1997, entitled "Continuous Tone Microfluidic Printing" to DeBoer, Fassler and Wen, application Ser. No. 08/868,416 filed Jun. 3, 1997 entitled "Microfluidic Printing on Receiver", to DeBoer, Fassler and Wen, application Ser. No. 08/868,102 filed Jun. 3, 1997 entitled "Microfluidic Printing with Ink Volume Control" to Wen, DeBoer and Fassler, application Ser. No. 08/868,477 filed Jun. 3, 1997 entitled "Microfluidic Printing with Ink Flow Regulation" to Wen, Fassler and DeBoer, all assigned to the assignee of the present invention. The disclosure of these related applications is incorporated herein by reference.

FIELD OF THE INVENTION

The present invention relates to printing high quality images by microfluidic pumping of inks into receivers such as paper.

BACKGROUND OF THE INVENTION

Microfluidic pumping and dispensing of liquid chemical reagents is the subject of three U.S. Pat. Nos. 5,585,069, 5,593,838, and 5,603,351, all assigned to the David Sarnoff Research Center, Inc. The system uses an array of micron sized reservoirs, with connecting microchannels and reaction cells etched into a substrate. Electrokinetic pumps comprising electrically activated electrodes within the capillary microchannels provide the propulsive forces to move the liquid reagents within the system. The electrokinetic pump, which is also known as an electroosmotic pump, has been disclosed by Dasgupta et al., see "Electroosmosis: A Reliable Fluid Propulsion System for Flow Injection Analysis", Anal. Chem. 66, pp 1792–1798 (1994). The chemical reagent solutions are pumped from a reservoir, mixed in controlled amounts, and them pumped into a bottom array of reaction cells. The array may be decoupled from the assembly and removed for incubation or analysis. When used as a printing device, the chemical reagent solutions are replaced by dispersions of cyan, magenta, and yellow pigment, and the array of reaction cells may be considered a viewable display of picture elements, or pixels, comprising mixtures of pigments having the hue of the pixel in the original scene. When contacted with paper, the capillary force of the paper fibers pulls the dye from the cells and holds it in the paper, thus producing a paper print, or photograph, of the original scene. One problem with this kind of printer is the accurate control of the print density. The problem comes about because the capillary force of the paper fibers is strong enough to remove all the ink from the device, draining it empty. If the paper is not removed from contact with the ink cells at the correct time, the print density will be too high or too low. Moreover, the correct paper contact time varies with the ambient temperature, making the timing problem more difficult. One solution to this problem is given in the above mentioned copending application entitled "Microfluidic Printing on Receiver", where a special paper is employed which will absorb only a limited amount of ink. It would be desirable to employ plain paper for this kind of printing.

SUMMARY OF THE INVENTION

It is an object of this invention to provide a microlluidic printer which can rapidly print a predetermined quantity of ink to produce a high quality image on a receiver.

This object is achieved by a microfluidic printing apparatus for transferring ink to a receiver, comprising:

a) at least one ink reservoir;

b) a structure defining a plurality of chambers arranged so that the chambers form an array with each chamber being arranged to form an ink pixel;

c) a plurality of microchannels connecting the reservoir to a chamber;

d) a plurality of microfluidic pumps each being associated with a single microchannel for supplying ink from an ink reservoir through a microchannel for delivery to a particular chamber;

e) means for delivering air to isolate ink in the chamber so that a predetermined amount of ink in the chamber can be transferred to a receiver; and f) control means for controlling the microfluidic pumps for delivering the predetermined amount of ink to each chamber.

ADVANTAGES

A feature of the present invention is that it provides apparatus which produces high quality prints of the correct density on a wide variety of receiver media.

Another feature of the invention is that the ink flow is accurately regulated using air to separate ink into segments.

DETAILED DESCRIPTION OF THE INVENTION

The present invention is described in relation to a microfluidic printing apparatus which can print computer generated images, graphic images, line art, text images and the like, as well as continuous tone images. In addition to the inks that are used for microfluidic printing of images, the apparatus can also be used with other types of fluids useful in the graphic arts industry.

Figure 1:
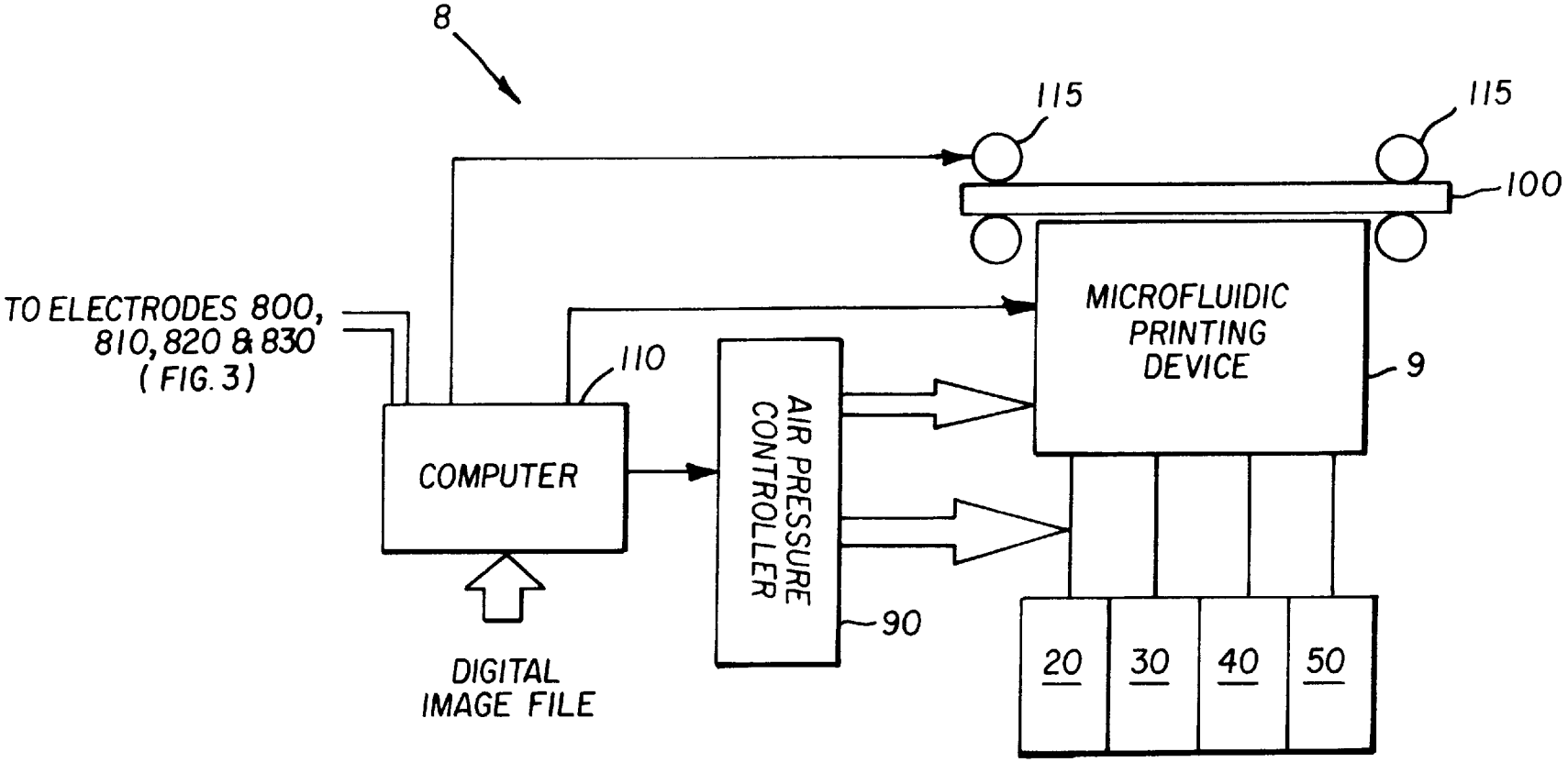
FIG. 1 is a partial schematic showing a microfluidic printing system for printing a digital image on a reflective receiver.

Referring to FIG. 1, a schematic diagram is shown of a printing apparatus 8 in accordance with the present invention. A microfluidic printing device 9 is connected with reservoirs 20, 30, 40 and 50 that provide respectively cyan ink, magenta ink, yellow ink and black ink. A colorless ink reservoir can also be added to vary the saturation or lightness of the inks as described in the above referenced commonly assigned U.S. patent application Ser. No. 08/868,426 filed Jun. 3, 1997. A computer 110 receives or generates data representing a digital image. The computer 110 also controls the electrokinetic or microfluidic pumps in the microfluidic printing device 9 according to the data representing the digital image. Although electrokinetic pumps are illustrated in the figures of this invention, it should be understood that other kinds of microfluidic pumps may also be used. The computer also controls a transport mechanism 115 that conveys the receiver 100 to the microfluidic printing apparatus 9 so that colored ink pixels may be transferred to the receiver 100. In a preferred embodiment of the present invention, the ink flow can be regulated by pressurized air which is controlled by an air pressure controller 90. The air pressure controller 90 is further controlled by the computer 110.

The inks used in this invention are dispersions of colorants in common solvents. Examples of such inks may be found is U.S. Pat. No. 5,611,847 by Gustina, Santilli and Bugner. Inks may also be found in the following commonly assigned U.S. patent application Ser. No. 08/699,955, Filed Aug. 20, 1996, application Ser. No. 08/699,962 Filed Aug. 20, 1996, and application Ser. No. 08/699,963 filed Aug. 20, 1996 by McInerney, Oldfield, Bugner, Bermel and Santilli, and in U.S. patent application Ser. No. 08/790,131 filed Jan. 10, 1997 by Bishop, Simons and Brick, and in U.S. patent application Ser. No. 08/764,379 by Martin. In a preferred embodiment of the invention the solvent is water. Colorants such as the Ciba Geigy Unisperse Rubine 4BA-PA, Unisperse Yellow RT-PA, and Unisperse Blue GT-PA are also preferred embodiments of the invention. The colorless ink of this invention is the solvent for the colored inks in the most preferred embodiment of the invention.

Figure 2:
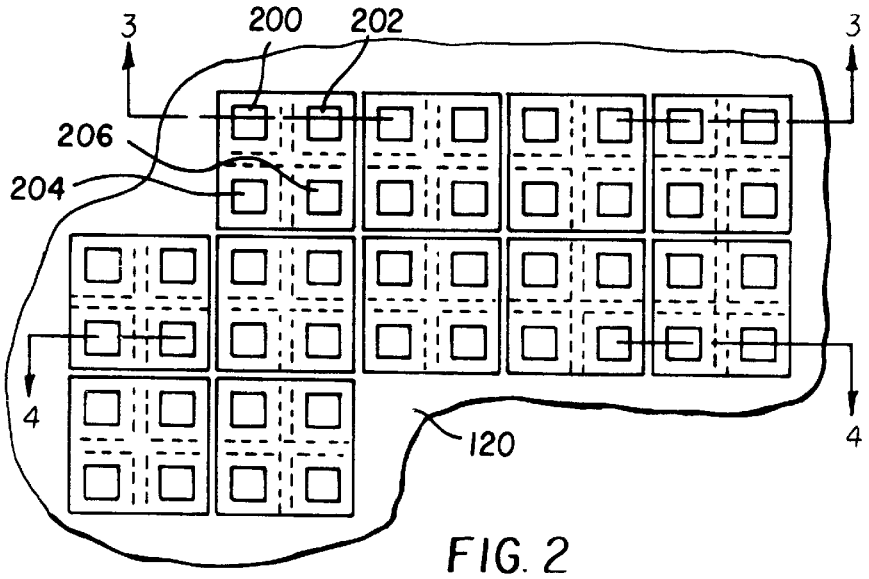
FIG. 2 is a top view of a pattern of the color pixels which can be produced by apparatus in accordance with the present invention.

FIG. 2 shows a top view of the printer front plate 120 with the colored ink orifices 200, 202, 204 and 206 which feed the ink chambers.

Figure 3:
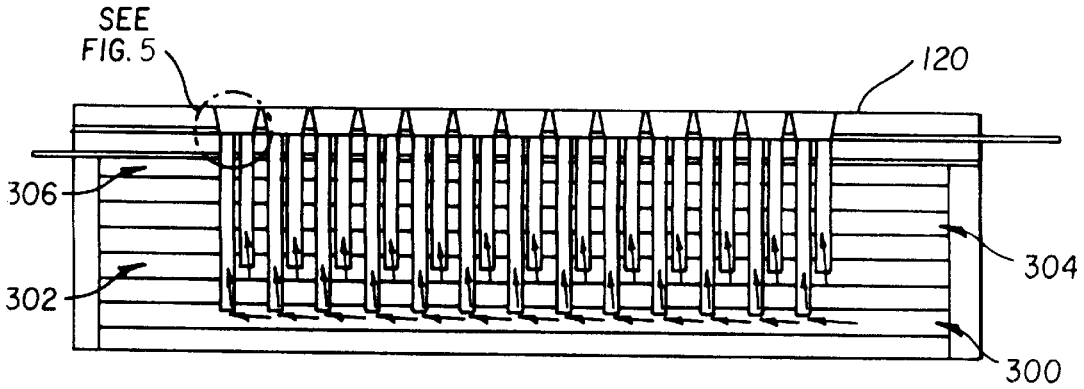
FIG. 3 is a cross-sectional view taken along the lines 3—3 of the microfluidic printing apparatus in FIG. 2.
Figure 4:
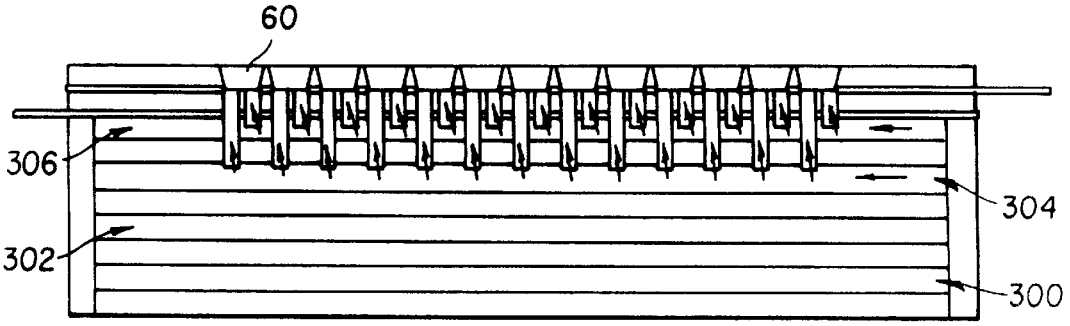
FIG. 4 is a cross-sectional view taken along the lines 4—4 of the microfluidic printing apparatus in FIG. 2.

Cross-sections of the color pixel arrangement shown in FIG. 2 are illustrated in FIGS. 3 and 4. FIG. 2 depicts a top view of an arrangement of chambers 60 in the printer front plate 120 shown in FIG. 1. The colored ink supplies 300, 302, 304 and 306 are fabricated in channels parallel to the printer front plate 120. The cyan, magenta, yellow and black inks are respectively delivered by color ink supplies 300, 302, 304 and 306 into each of the colored ink chambers 60.

The microchannel capillaries, ink pixel chambers 60 and microfluidic pumps are more fully described in the references listed above.

In the present invention, the ink chambers 60 deliver the inks directly to a receiver; however, other types of ink delivery arrangements can be used which do not employ ink mixing chambers and the invention should be understood to include those arrangements.

Figure 5:
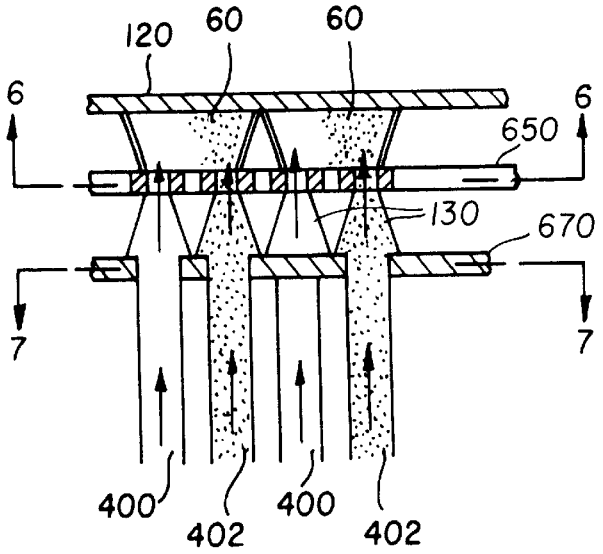
FIG. 5 is an enlarged view of the circled portion of FIG. 3.
Figure 7:
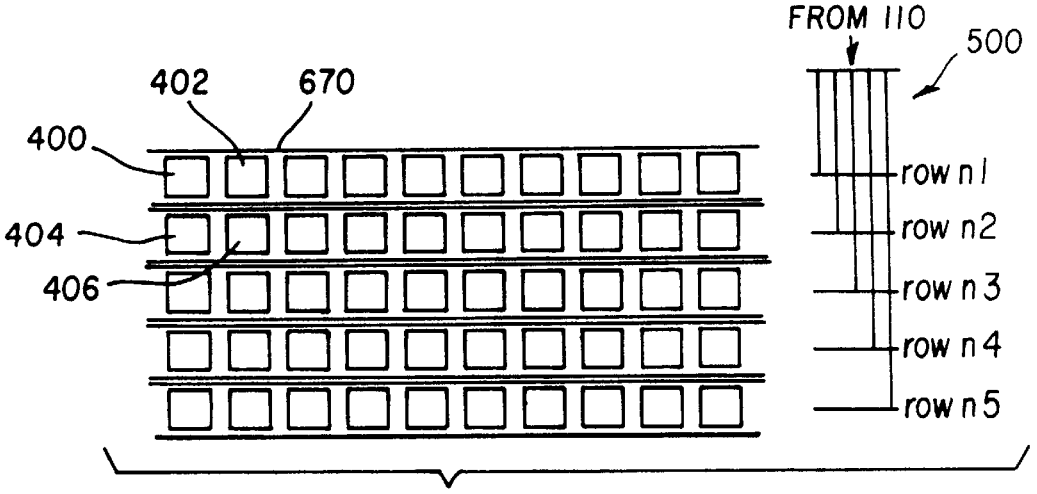
FIG. 7 is a top view of the microchannel showing the conducting circuit connections along the line 7–7 of FIG. 5.

A detailed view of the cross-section in FIG. 3 is illustrated in FIG. 5. The colored inks are delivered to the ink chambers 60 respectively by the electrokinetic pumps 130 through cyan, magenta, yellow and black ink microchannels 400, 402, 404 and 406 (404 and 406 are not shown in FIG. 5, but are illustrated in FIG. 7). The colored ink microchannels 400, 402, 404 and 406 are respectively connected to the colored ink supplies 300, 302, 304 and 306 (FIGS. 3 and 4).

Figure 6:
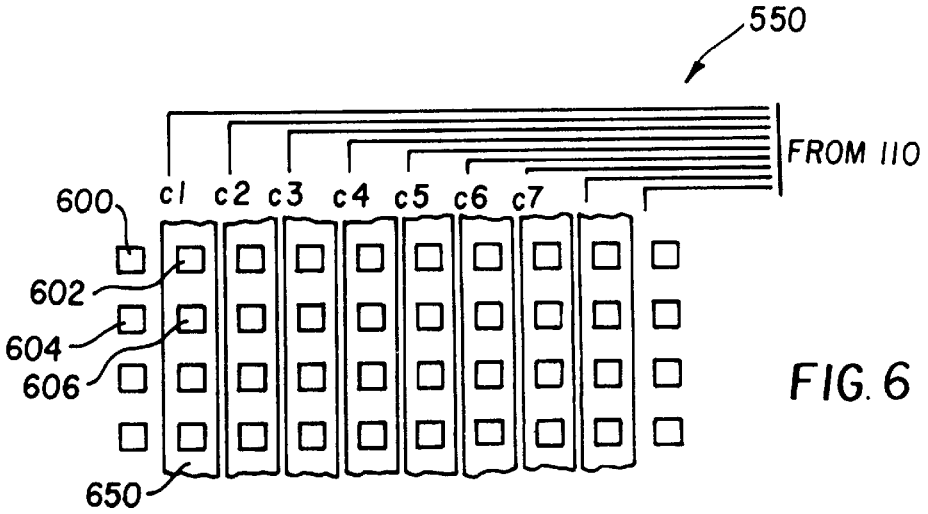
FIG. 6 is a top view of the micronozzles showing the conducting circuit connections of FIG. 5.

A top view of the plane containing the micronozzels in FIG. 5 is shown in FIG. 6. The cyan, magenta, yellow and black ink micronozzels 600, 602, 604 and 606 are distributed in the same arrangement as the colored ink supply lines 300–304 and electrodes 650 are shown connected to the conducting circuit 550, which is further connected to computer 110 which controls their operation.

A top view of the plane containing the microchannels 400, 402, 404 and 406 of FIG. 5 is shown in FIG. 7. The colored ink channels 400–406 are laid out is the spatial arrangement that corresponds to those in FIGS. 2 and 6. The lower electrodes 670 in the electrokinetic pumps 130 for delivering the colored inks are shown connected to the conducting circuit 500, which is further connected to the computer 110.

Figure 8:
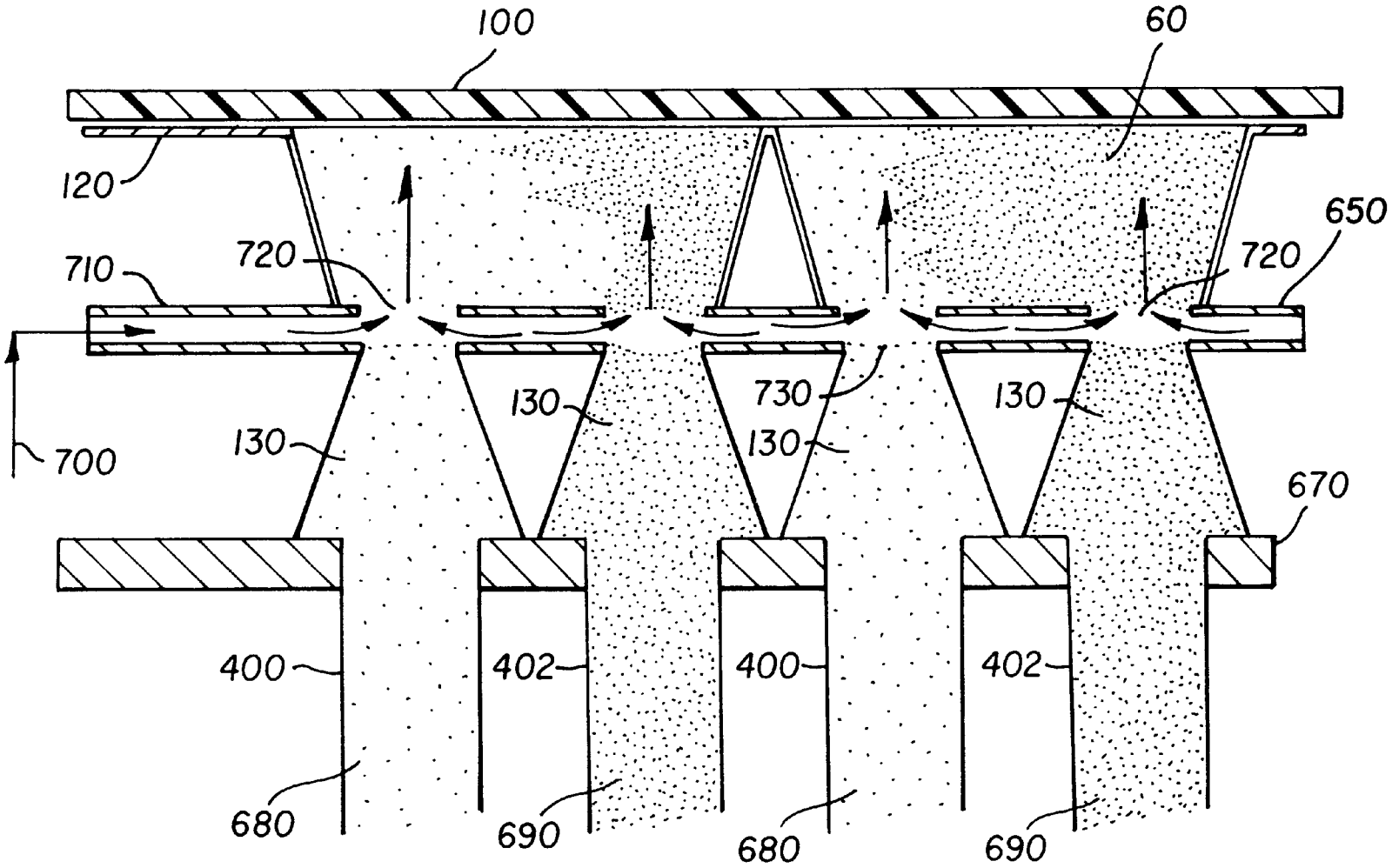
FIG. 8 shows a cross-sectional view of the ink delivery control means in one embodiment of the invention.

FIG. 8 shows a cross-sectional view of the ink delivery control means of the first preferred embodiment of this invention. The colored inks 680 and 690 are provided by the microchannels 400 and 402 and delivered by electrokinetic pumps 130 to ink chambers 60. The colored inks are mixed in the ink chamber 60. The amounts of the inks to be delivered to the receiver 100 by each ink chamber 60 are determined by the input digital image file. When the correct amount of the inks are delivered to the ink chambers 60 by the electrokinetic pumps 130, the air pressure controller 90 delivers pressurized air 700 through air channel 710 to form air bubbles 720 at the pinch nozzles 730. The fluid connection between the electrokinetic pump 130 and the ink chambers 60 is thus shut off. Since the ink mixture in the ink chambers 60 is separated from the ink supply 680, the contact time with the receiver is no longer critical. In addition, because the ink mixture in the chamber 60 is disconnected from the ink supply, the requirements for the receiver type are much relaxed, and a wide variety of receivers can be used in the apparatus. Such receivers include common bond paper, made from wood fibers, as well as synthetic papers made from polymeric fibers. In addition receivers can be of non-fibrous construction, provided they absorb and hold the ink used in the printer.

Figure 9A:
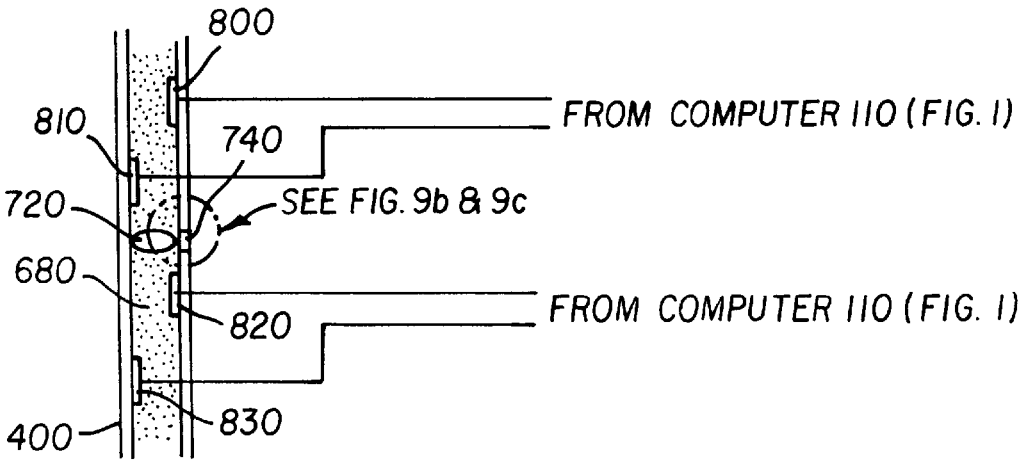
FIGS. 9A–C are cross-sectional views of different portions of the microchannel and showing an arrangement for introducing air to form two different ink segments.
Figure 9B:
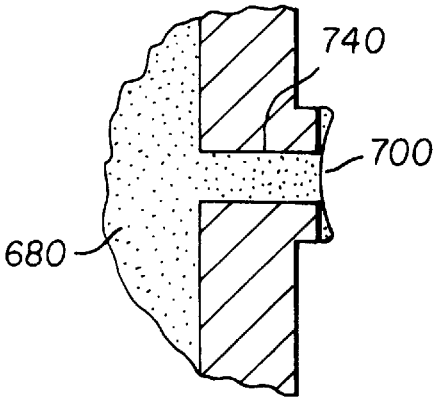
Figure 9C:
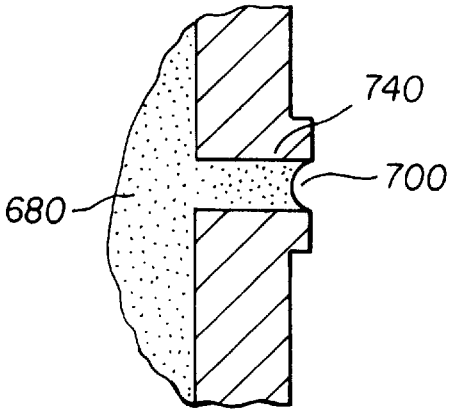

FIG. 9 illustrates a second preferred embodiment of the invention. In FIG. 9*a*, a section of the cyan ink microchannel 400 is shown with a dual pair of electrokinetic pump electrodes, disposed above and below an opening 740 in the microchannel. The top electrodes 800 and 810 constitute one electrokinetic pumps and the bottom electrodes 820 and 830 constitute a second electrokinetic pump. The electrodes 800, 810, 820, and 830 are controlled by the computer 110 to adjust the amount of ink delivered to each segment. When both pumps are operated in the same direction, the ink flows normally in the microchannel, and the opening 740 fills with ink. Depending on the material of which the opening 740 is made, the meniscus of the ink will be as shown in FIG. 9*b* if the ink wets the surface, or as in FIG. 9*c*, if the ink does not wet the surface. When the pumps of FIG. 9*a* are operated in opposite directions, a bubble of air 720 will be drawn into the microchannel from the opening 740, thus providing the control of the ink flow as described under FIG. 8. The advantage of this method of generating bubbles is that each bubble can be generated independent of the others, as controlled by the computer 110.

The invention has been described in detail with particular reference to certain preferred embodiments thereof, but it will be understood that variations and modifications can be effected within the spirit and scope of the invention.

PARTS LIST

| | |
|---|---|
| 8 | microfluidic printing system |
| 9 | microfluidic printing device |
| 10 | colorless ink reservoir |

-continued

| PARTS LIST | |
|---|---|
| 20 | cyan ink reservoir |
| 30 | magenta ink reservoir |
| 40 | yellow ink reservoir |
| 50 | microchannel capillaries |
| 60 | ink chambers, or printing nozzles |
| 70 | electrokinetic pumps |
| 80 | black ink reservoir |
| 90 | air pressure controller |
| 100 | receiver |
| 110 | computer |
| 115 | transport mechanism |
| 120 | printer front plate |
| 130 | electrokinetic pump |
| 200 | colored ink orifices |
| 202 | colored ink orifices |
| 204 | colored ink orifices |
| 206 | colored ink orifices |
| 300 | colored ink supply lines |
| 302 | colored ink supply lines |
| 304 | colored ink supply lines |
| 306 | black ink supply |
| 400 | cyan ink microchannel |
| 402 | magenta ink microchannel |
| 404 | yellow ink microchannel |
| 406 | black ink microchannel |
| 500 | conducting circuit |
| 550 | conducting circuit |
| 600 | cyan ink micro-orifice |
| 602 | magenta ink micro-orifice |
| 604 | yellow ink micro-orifice |
| 606 | black ink micro-orifice |
| 650 | column electrodes |
| 670 | row electrodes |
| 680 | cyan ink |
| 690 | magenta ink |
| 700 | pressurized air |
| 710 | air channel |
| 720 | air bubble |
| 730 | pinch nozzle |
| 740 | opening |
| 800, 810, 820, 830 | electrodes |

What is claimed is:

1. A microfluidic printing apparatus for transferring ink to a receiver, comprising:

a) at least one ink reservoir;

b) a structure defining a plurality of chambers arranged so that the chambers form an array with each chamber being arranged to form an ink pixel;

c) a plurality of microchannels connecting the ink reservoir to a chamber of said plurality of chambers;

d) a plurality of microfluidic pumps each pump being associated with a single microchannel of said plurality of microchannels for supplying ink from the ink reservoir to a particular chamber of said plurality of chambers;

e) means for delivering air to isolate ink in said plurality of chambers so that a predetermined amount of ink in said plurality of chambers can be transferred to a receiver; and f) control means for controlling the microfluidic pumps for delivering the predetermined amount of ink to each of said plurality of chambers.

2. A microfluidic printing apparatus according to claim 1 wherein the air delivering means includes an air channel for delivering air between each microfluidic pump and its associated chamber.

3. A microfluidic printing apparatus for transferring ink to a receiver, comprising:

a) at least one ink reservoir;

b) a structure defining a plurality of chambers arranged so that the chambers form an array with each chamber being arranged to form an ink pixel;

c) a plurality of microchannels connecting the ink reservoir to a chamber of said plurality of chambers;

d) means for providing communication between said at least one ink reservoir and said plurality of chambers and including a plurality of pinch nozzles;

e) a plurality of microfluidic pumps wherein there are at least a forward pump and a rear pump associated with a pinch nozzle of said plurality of pinch nozzles for each of said plurality of chambers, each microfluidic pump including two spaced apart electrodes;

f) means for delivering air to the ink in said plurality of microchannels defining an opening in each of said plurality of microchannels from which the air can be introduced into each of said plurality of microchannels to isolate the ink into ink segments, each segment having a predetermined amount of ink; and g) control means for controlling the microfluidic pumps for delivering the predetermined amount of ink to each of said plurality of chambers and wherein the control means operates the spaced apart electrodes of the forward pump and the rear pump to cause ink to flow in a first direction towards each of said plurality of chambers and operates the electrodes of the rear pump to oppose the flow of ink causing air to be introduced in the pinch nozzles to separate or isolate the ink to form at least two segments.

* * * * *